US006315595B1

(12) United States Patent
LaPorte et al.

(10) Patent No.: US 6,315,595 B1
(45) **Date of Patent: *Nov. 13, 2001**

(54) MODULAR IDC TERMINAL

(75) Inventors: Richard LaPorte, Ft. Worth; Casimir Z. Cwiren, Colleyville; Roger L. Paradis, Ft. Worth, all of TX (US)

(73) Assignee: Corning Cable Systems LLC, Hickory, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,585

(22) Filed: Jun. 3, 1998

(51) Int. Cl.[7] ..... H01R 11/20
(52) U.S. Cl. ..... 439/412; 439/403
(58) Field of Search ..... 439/412, 411, 439/413, 717, 850, 851, 402, 403, 701, 709, 715

(56) References Cited

U.S. PATENT DOCUMENTS

| | | | | |
|---|---|---|---|---|
| Re. 35,476 | | 3/1997 | Levy | 439/411 |
| 3,042,895 | * | 7/1962 | Bonhomme | 429/701 |
| 4,171,862 | * | 10/1979 | Krasser | 439/717 |
| 4,533,195 | | 8/1985 | Knickerbocker | 439/391 |
| 4,580,864 | | 4/1986 | Knickerbocker | 439/395 |
| 4,652,071 | | 3/1987 | DeBortoli et al. | 439/396 |
| 4,682,835 | | 7/1987 | Aujla et al. | 439/395 |
| 4,741,480 | | 5/1988 | Despault et al. | 439/412 |
| 4,764,125 | | 8/1988 | Debortoli | 439/403 |
| 4,826,449 | | 5/1989 | Debortoli et al. | 439/411 |
| 4,854,899 | * | 8/1989 | Matthews | 439/724 |
| 5,069,636 | | 12/1991 | Shimirak et al. | 439/412 |
| 5,102,347 | | 4/1992 | Cote et al. | 439/412 |
| 5,112,245 | | 5/1992 | Shimirak et al. | 439/412 |
| 5,167,526 | | 12/1992 | Pinyan et al. | 439/411 |
| 5,173,060 | | 12/1992 | Shimirak et al. | 439/416 |
| 5,288,251 | * | 2/1994 | Sumida | 439/701 |
| 5,324,212 | | 6/1994 | Fremgen et al. | 439/412 |
| 5,449,299 | | 9/1995 | Shimirak et al. | 439/417 |
| 5,836,791 | * | 11/1998 | Wass et al. | 439/709 |
| 5,863,215 | * | 1/1999 | Debbaut et al. | 439/412 |

OTHER PUBLICATIONS

AMP Quiet Front Terminal Blocks Catalog 8982257; 12/93.
Raychem Pedestal Terminal Blocks Product Information; 12/93.
Raychem Pole Mounted Terminal Product Information; 12/92.
Raychem Site Terminated Module Installation Instructions; 07/94.
Raychem Strand or Pole Mounted Terminal Installation Instructions; 08/94.

* cited by examiner

*Primary Examiner*—Brian Sircus
*Assistant Examiner*—Son V. Nguyen

(57) ABSTRACT

A distribution terminal for connecting incoming telephone cable wires to drop lines has a plurality of bases. Each of the bases has a platform and two lateral sides on opposite edges of the platform. Mating releasable connectors are on each of the lateral sides of the bases for securing a number of the bases together, side-by-side. Each of the bases has three electrically conductive penetrators extending through the platform. Two of the penetrators have terminal ends for connection to a twisted-pair of wires of the incoming telephone cable. The third penetrator is connected to a ground. A module may be releasably secured to each of the bases over the platform. Each module has a pair of IDC clips. Each clip engages one of the penetrators when the module is secured to the base. Each of the modules has a pair of holes adjacent to the clips for receiving ends of drop wires. An actuator for each of the modules pushes the drop wires into engagement with the clips. Each of the actuators has a plunger for pushing the drop wires into engagement with the IDC clips. The plunger moves relative to the housing of the module as the module remains stationarily attached to the base.

20 Claims, 4 Drawing Sheets

MODULAR IDC TERMINAL

TECHNICAL FIELD

This invention relates in general to electrical connectors and in particular to terminal blocks for connecting incoming telephone cables to individual drop lines.

BACKGROUND ART

Terminal blocks are commonly used in telephone distribution lines. For example, a telephone cable will lead from the telephone company system to a terminal block. The terminal block has a base with a number of connection stations, for example 10 to 15. Each station has a separate electrical connector which will connect one twisted-pair of wires in the incoming telephone cable to one of the drop lines which lead to one of the individual telephone sets. The wires from the incoming telephone cable are prewired into the stations of the base. Each station has two holes for insertion of the two wires from one of the drop lines. Normally, the station will have an installation displacement terminal (referred to as "IDC) registering with each of the holes. An IDC terminal allows the operator to insert the ends of the drop line into the holes in the station without stripping the insulation from the ends. The IDC terminal has a slit with two sharp edges that are biased toward one another. The wires are pressed through the slit toward the base, making contact without the need for stripping.

When installing distribution terminals, it is not uncommon for the telephone company cable to have more capacity initially than will be required by individual drop lines. For example, the incoming cable may have a capacity for 15 sets of drop lines, but only eight will be initially used, although it is possible in the future that the rest will be needed. The company installing the distribution terminal may install a terminal block that has 15 separate stations to match the full capacity of the cable even though only eight are being used. Later, when the others are going to be used, the drop lines can simply be inserted into the stations. However, a larger terminal block than initially needed is more expensive. If the company elects to install a smaller terminal block, it may find that it later has to replace the smaller terminal block with a larger one.

DISCLOSURE OF INVENTION

In this invention, the distribution terminal has a plurality of bases. Each of the bases has a platform and two lateral sides on opposite edges of the platform. Mating connectors are on each of the lateral sides of the bases for securing a number of the bases together, side-by-side. The bases can thus be assembled to a desired number to match the incoming telephone cable.

Each of the bases has three electrically conductive penetrators extending through the platform. Two of the penetrators have terminal ends for connection to a twisted-pair of wires of the incoming telephone cable. The third penetrator is connected to a ground. A module may be secured to each of the bases over the platform. Each module has a pair of electrical contacts, preferably IDC clips. Each clip engages one of the penetrators when the module is secured to the base. Each of the modules has a pair of holes adjacent to the clips for receiving ends of the drop wires. An actuator for each of the modules pushes the drop wires into engagement with the clips.

The base is preferably made up to match the full capacity of the feed cable coming from the telephone company. Modules are installed only as needed. If the base has the capacity for 12 drop wire pairs, and only eight are needed, then only eight modules will be provided. Later, if additional modules are needed, they are simply snapped into place to the empty bases.

In the preferred embodiment, each of the actuators has a plunger for pushing the drop wires into engagement with the IDC clips. The plunger moves relative to the housing of the module as the module remains stationarily attached to the base. Rotating a screw in one direction causes the plunger to move toward the base.

BEST MODE FOR CARRYING OUT THE INVENTION

Figure 1:
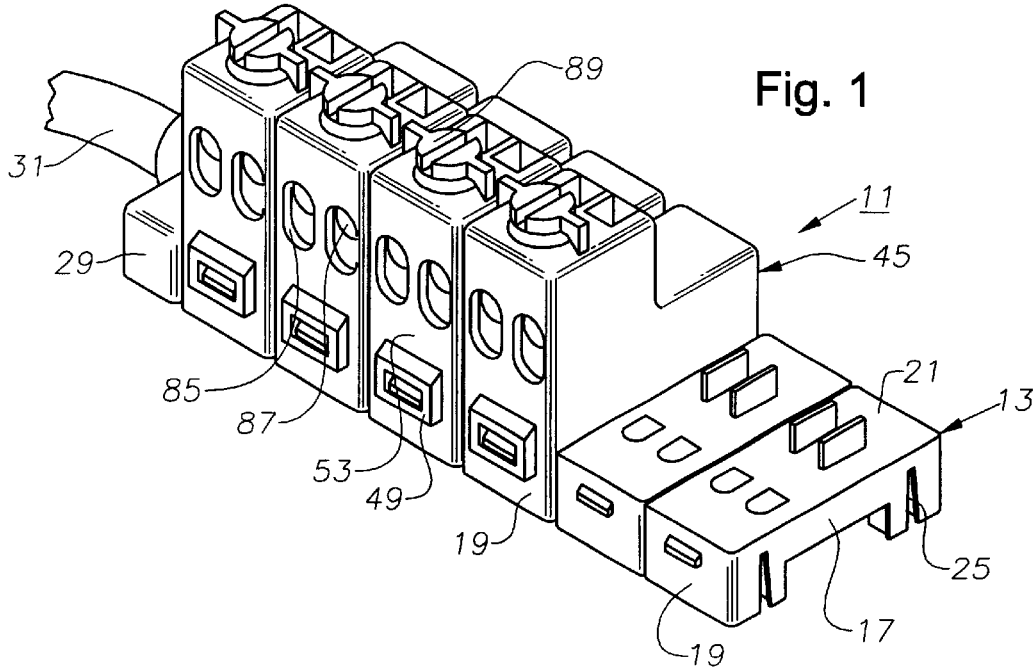
FIG. 1 is a perspective showing a distribution terminal block constructed in accordance with this invention.
Figure 2:
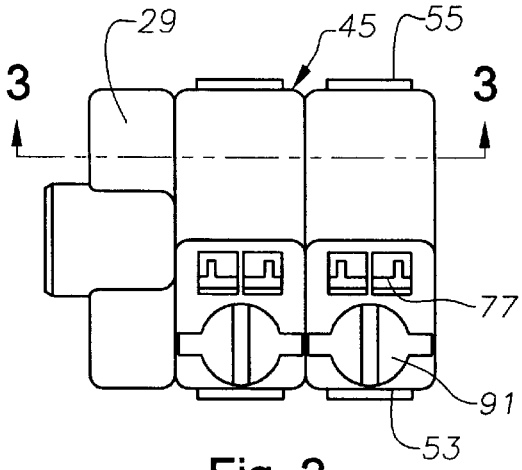
FIG. 2 is a top view of the terminal block of FIG. 1, but showing only two of the modules.
Figure 4:
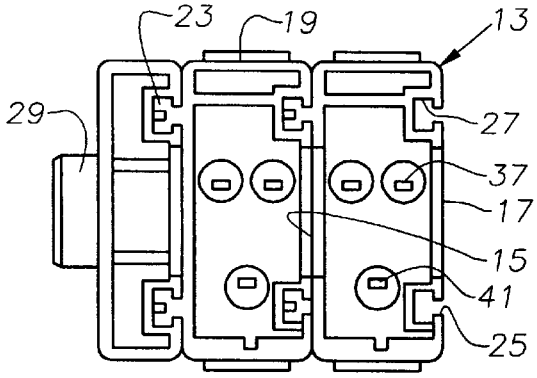
FIG. 4 is a bottom view of the terminal block of FIG. 2.
Figure 3:
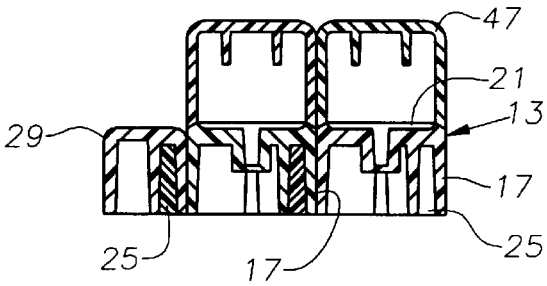
FIG. 3 is a sectional view of the terminal block of FIG. 2, taken along the line 3—3 of FIG. 2.
Figure 6:
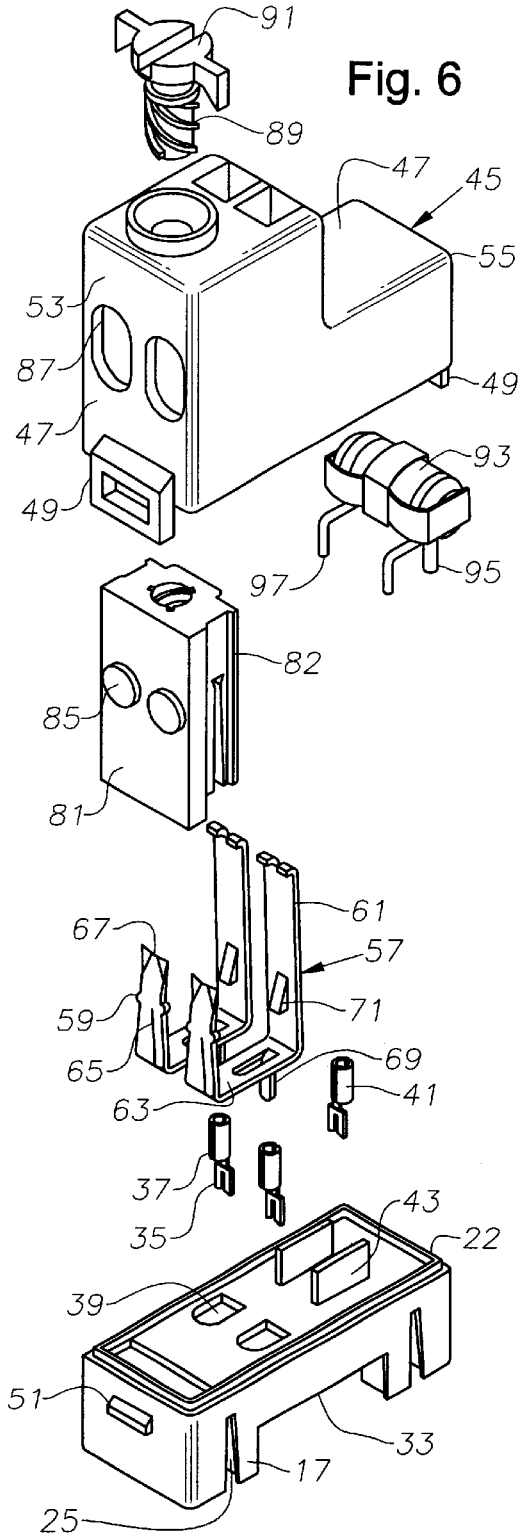
FIG. 6 is an exploded isometric view of one of the modules and one of the bases of the terminal block of FIG. 1.
Figure 7:
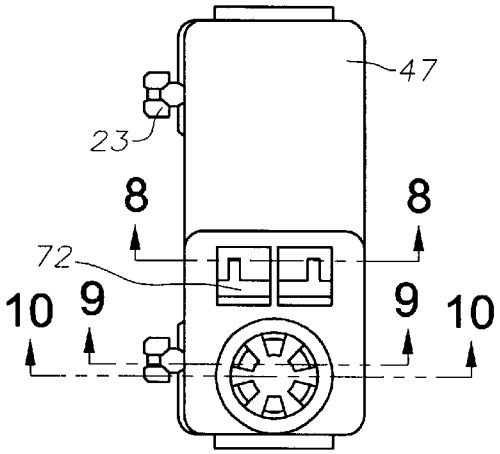
FIG. 7 is a top view of one of the modules and bases of the terminal block of FIG. 1.
Figure 8:
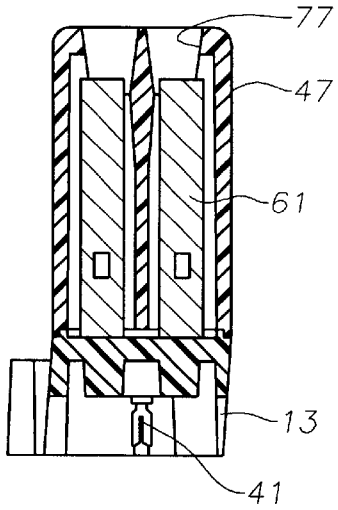
FIG. 8 is a sectional view of the module and base of FIG. 7, taken along the line 8—8 of FIG. 7.
Figure 9:
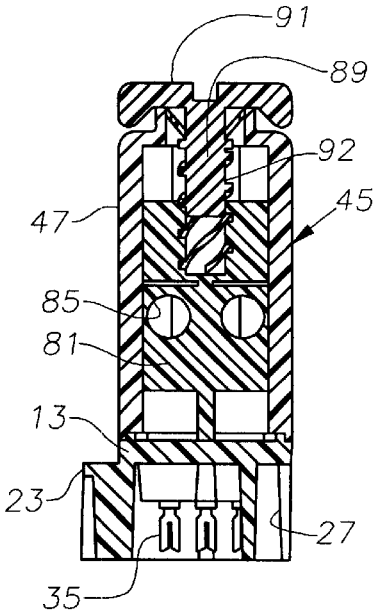
FIG. 9 is a sectional view of the module and base of FIG. 7, taken along the line 9—9 of FIG. 7.

Referring to FIG. 1, distribution terminal block 11 has a plurality of bases 13. In the drawing, six bases 13 are shown, but the number can be varied. Referring also to FIG. 4, each base 13 has lateral walls 15, 17 and end walls 19. Each base 13 is rectangular with lateral walls 15, 17 being perpendicular to end walls 19. As shown in FIG. 6, a flat platform 21 forms a top of each base 13, platform 21 being perpendicular to walls 15, 17 and 19. A lip 22 for sealing is located at the perimeter of platform 21.

Figure 5:
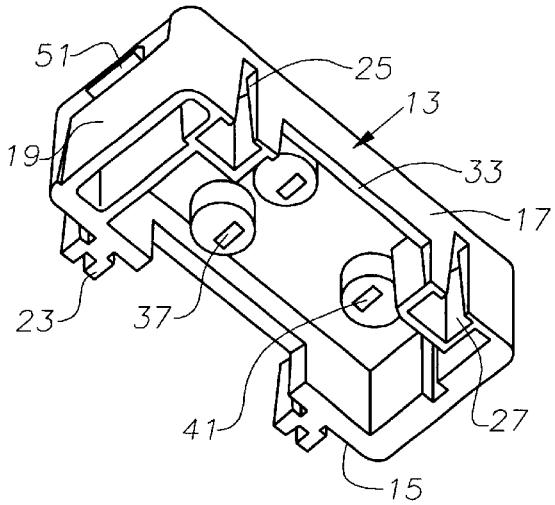
FIG. 5 is a bottom isometric view of one of the bases of the terminal block of FIG. 1.

Referring also to FIG. 5, two connector lugs 23 are formed on lateral wall 15 and extend laterally outward therefrom. Two connector slots 25 are formed in lateral wall 17. Each slot 25 extends from the lower edge of wall 17 and converges in a direction toward platform 21. A separate rectangular cavity 27 is located on the inner side of lateral wall 17 in registry with each slot 25. Slot 25 and cavity 27 are adapted to receive one of the lugs 23 from an adjacent base 13. Bases 13 are connected together by sliding lugs 23 into the slots 25 of the adjacent base 13, with the friction between lugs 23 and cavities 27 retaining the bases 13 together.

Referring again to FIG. 1, a wire feed 29 will be located on one of the ends of terminal block 11 for feeding in a telephone company incoming cable 31, which in the embodiment shown, contains a number of twisted-pair wires. Closure members (not shown) may be inserted into slots 25 on the exposed unused lateral side 17 of the last base 13. The wires of distribution cable 31 extend within the hollow bases 13, passing through recesses 33 (FIGS. 5, 6) formed in each of the lateral walls 15, 17. The twisted pairs of wires contained in distribution cable 31 are separately prewired and connected to each of the bases 13.

Each incoming wire will be connected to a terminal 35 of a penetrator 37 which extends through a hole 39 in each platform 21, shown in FIG. 6. There will be a separate penetrator 37 for each of the wires. One of the penetrators 37 will be for the wire known as the tip wire, and the other for the ring wire. Also, a third penetrator 41 is provided for a ground wire. Each penetrator 37, 41 has an upward facing socket. In the embodiment shown, a pair of supports 43, which are rectangular spaced apart walls, extend upward from platform 21 generally parallel with lateral walls 15, 17. A module 45 connects to each of the bases 13. Each module 45 includes a housing 47 which has a lower end that has a rectangular lower perimeter for tightly and closely fitting around lip 22 of platform 21. Latch members 49 on housing 47 engage shoulders 51 on end walls 19 of bases 13. Each latch 49 is flexible and resilient and depends from a lower edge of housing 47, one from forward end wall 53 and the other from rearward end wall 55. Forward end wall 53 has a greater axial dimension than rearward end wall 55 in the embodiment shown.

A pair of electrically conductive IDC clips 57 are located within each housing 47. Each clip 57 has a generally J-shaped configuration, having a short forward leg 59, a longer rearward leg 61 and a flat base 63 which joins legs 59, 61. Clip base 63 will be parallel to platform 21 once module 45 is installed. Forward leg 59 has an axial slit 65 which defines a pair of sharp edges biased toward each other. A slightly concave entry edge 67 is located at the upper end of slit 65. When an insulated wire is placed on entry edge 67 and pushed downward toward platform 21, the sharp edges of slit 65 will cut the insulation and create electrical continuity with clip 57. A prong 69 depends from clip base 63 and locates in one of the sockets of one of the terminals 35. Electrical continuity between one of the wires from incoming cable 31 (FIG. 1) is thus established through penetrator 37 and clip 57.

Figure 12:
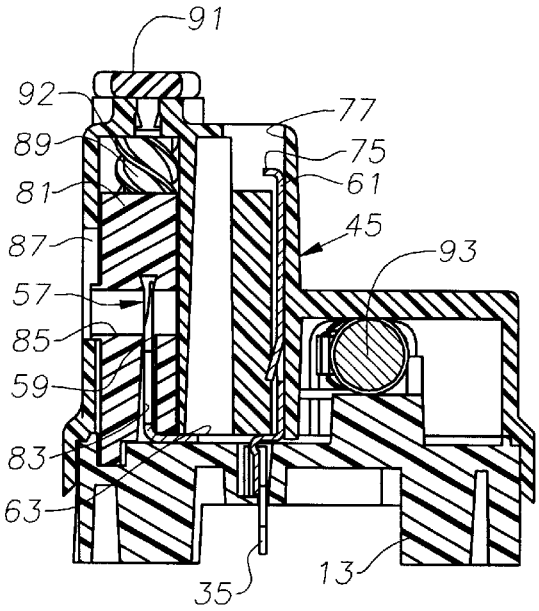
FIG. 12 is a sectional view of the module and base of FIG. 11, taken along the line 12—12 of FIG. 11, and shown in a closed position.
Figure 13:
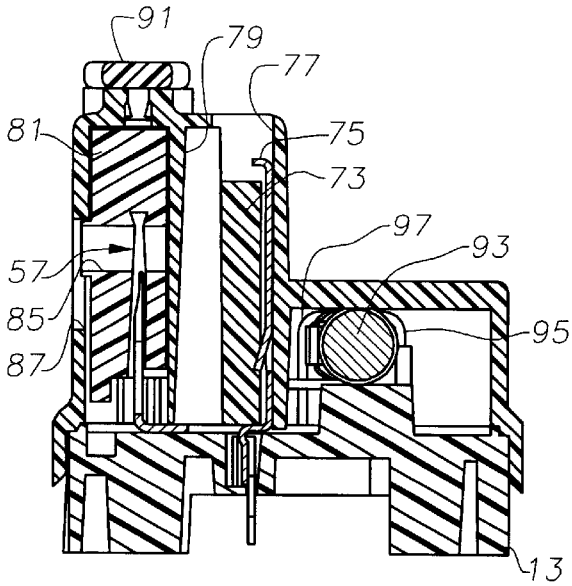
FIG. 13 is the same sectional view as FIG. 12, but showing the actuator in an open position.

Rearward leg 61 of clip 57 has a tab 71 that is bent in a forward direction for retaining clip 57 in housing 47. Tab 71 engages a shoulder located on a partition 73, which is shown in the sectional views of FIGS. 12 and 13. Referring still to FIGS. 12 and 13, each clip 57 has an upper end 75 that extends above partition 73 and is exposed to an access port 77 extending downward from the top of housing 47. Access port 77 enables one to test continuity of the connection made up by module 45 without removing module 45 from base 13.

Figure 10:
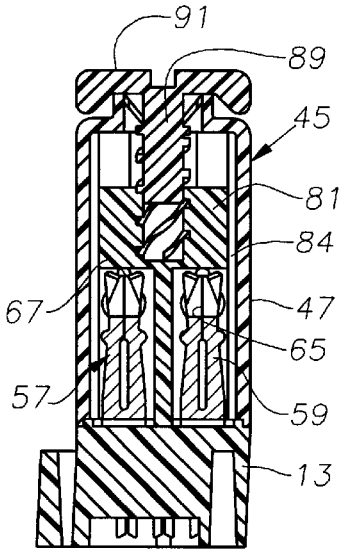
FIG. 10 is a sectional view of the module and base of FIG. 7, taken along the line 10—10 of FIG. 7.

A second vertical partition 79 is located forward of partition 73, and divides this rearward portion of module 45 into two separate cavities. The more forward cavity contains a plunger 81 that moves reciprocally along an axis relative to housing 47. Plunger 81 is shown in an upper open position in FIG. 13 and a closed lower position in FIG. 12. Plunger 81 is prevented from rotation relative to housing 47 by a keyway comprising a rib 82 (FIG. 6) which engages a slot located between two ribs 84 (FIG. 10, only one shown) formed on the inner wall of housing 47. Ribs 82 are located on both sides of plunger 81.

Plunger 81 has two axially extending cavities 83, each of which closely receives forward leg 59 of one of the clips 57. A pair of transverse apertures 85 extend completely through plunger 81 perpendicular to the axis and perpendicular to each forward leg 59. Each aperture 85 intersects one of the cavities 83 near the upper end of cavity 83. While in the open position, the entry edge 67 of each clip 57 will be located below one of the apertures 85. While in the lower position, the entry edge 67 of each clip 57 will be slightly above one of the apertures 85. Each aperture 85 is cylindrical in the embodiment shown.

Figure 11:
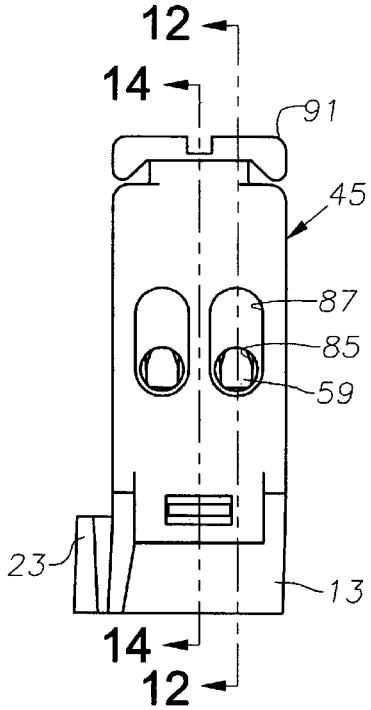
FIG. 11 is a front elevational view of one of the modules and bases of the terminal block of FIG. 1.

Each aperture 85 registers with an elongated hole 87 formed in forward end wall 53. Hole 87 has a width that is only slightly larger than the diameter of each aperture 85 but an axial length that is more than twice the diameter of each aperture 85. Each aperture 85 will register with one of the holes 87 both in the upper and the lower position as can be seen in FIGS. 11–13.

Figure 14:
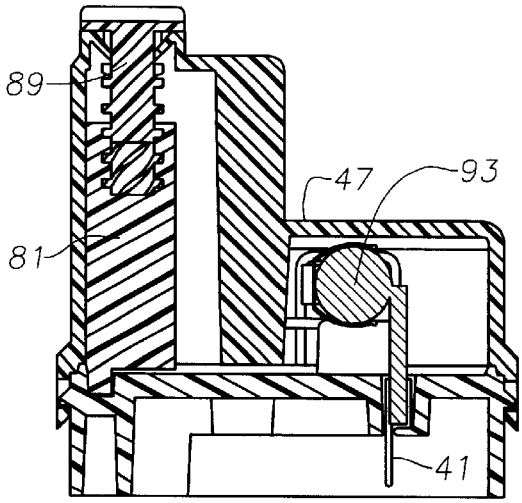
FIG. 14 is a sectional view of the module and base of FIG. 1, taken along the line 14—14 of FIG. 11, and showing the actuator in a closed position.
Figure 15:
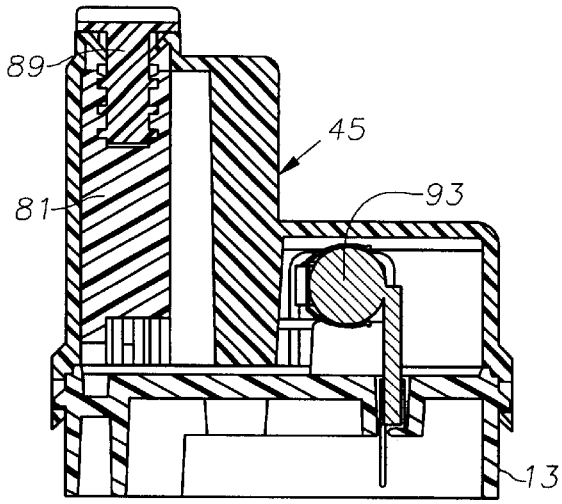
FIG. 15 is the same sectional view as FIG. 14, but showing the actuator in an open position.

A rotary member moves plunger 81 between the open and closed positions. The rotary member is a screw 89 having a helical thread with multiple starts. Screw 89 has a head 91 located on the upper end of housing 47 and engages mating threads 92 (FIG. 14) formed in a receptacle in plunger 81. Rotation of less than one turn will stroke plunger 81 fully from the open to the closed position. Depending on the gauge of the drop lines, the rotation may be accomplished manually, either by the fingers alone or with a screw driver.

Module 45 may optionally be provided with a protector 93, which will be mounted in a cavity 94 separate and rearward from the cavities containing clips 57 and plunger 81. The cavities containing clips 57 and plunger 81 are filled with an insulation gel, but cavity 94 does not contain gel. Protector 93 is a commercially available electrical device for protecting equipment against high or excessive voltage, such as caused by lightning strikes. Protector 93 has two contacts (not shown) spaced apart by an insulation gap, which is bridged if the voltage applied is high enough. Protector 93 has a ground leg 95 and tip and ring legs 97. Ground leg 95 joins ground penetrator 41 (FIG. 6). Tip and ring legs 97 are electrically connected with clips 57, preferably by soldering. Excessive voltage applied to either of the penetrators 37 will discharge through protector 93 to ground through penetrator 41.

In operation, terminal block 11 will be assembled by connecting a selected number of bases 13 to each other with lugs 23 locating within slots 25 (FIGS. 5, 6). Preferably, enough bases 13 will be assembled to match the capacity of the incoming distribution cable 31. The twisted-pair wires within distribution cable 31 will be prewired to each of the bases 13 by connecting each of the wires to the various penetrators 37 and by connecting each penetrator 41 to a common ground wire that is part of the incoming cable 31. Then, a number of modules 45 will be snapped onto the bases 13 using latches 49. When modules 45 are placed on bases 13, the prongs 69 of each of the clips 57 will engage penetrators 37. If a protector 93 is used, ground leg 95 will enter the socket of penetrator 41 and protector 93 will locate on supports 43. Some of the bases 13, even though prewired with wires from incoming cable 31, may be left unused without any modules 45 until later needed.

To install drop lines, the tip and ring wires are inserted into holes 87 and apertures 85 while plunger 81 is in the open position shown in FIG. 13. This places each wire directly above the entry edge 67 of each slit 65 (FIG. 6). Then screw 89 is rotated, which strokes plunger 81 toward base 13. This pushes the wires downward through the slits 65, cutting the insulation and establishing electrical continuity between the wires and clips 57. Continuity to the distribution wires of incoming cable 31 (FIG. 1) is established through penetrators 37. The continuity may be checked by using the rearward legs 61 of clips 57 and access ports 77. Additional modules 45 may be added at any time.

The invention has significant advantages. The individual connectable bases allow one to easily make a variety of sizes of a terminal block. The modules are readily installed by using latches. The IDC connector makes contact with the wires after the modules have been installed, not during installation of the modules. Some of the bases may be left free of modules to reduce expense until later needed.

While the invention has been shown in only one of its forms, it should be apparent to one skilled in the art that it is not so limited, but is susceptible to various changes without departing from the scope of the invention. For example, although shown for use with twisted-wire pairs, the principles could be applied also to coaxial cable distribution blocks. In yet another example of an application for the present invention, the IDC housing with the plunger may be utilized to electrically interconnect wire leads and network ir premises wiring in the outside plant, central office or home environment of the telecommunications network, for example in network interface devices, building entrance terminals, optical network interface units, aerial terminals or other network deployment apparatus. The IDC clips may be electrically connected to the network or premises wiring through a second IDC or other suitable means well known in the art, for example soldering or terminal posts or spade clips.

We claim:

1. A distribution terminal for connecting a plurality of drop wires to a plurality of distribution wires, comprising:

a plurality of bases, each of the bases having a platform and lateral sides on opposite edges of the platform;

mating connectors on each of the lateral sides of the bases for securing adjacent bases together;

each of the bases having at least one conductive penetrator extending through the platform, the penetrator having a terminal end prewired to one of the distribution wires;

at least one module releasably attached to one of the bases over the platform, the module having a pair of holes for receiving a corresponding pair of the drop wires therein; and a least one electrical contact mounted within the module, the contact releasably engaging the penetrator when the module is secured to the base so that the module is removable from the base without disconnecting the distribution wire prewired to the terminal end of the penetrator.

2. The distribution terminal according to claim 1, wherein the mating connectors comprise:

a lug protruding from one of the lateral sides of each of the bases and a slot located on the other of the lateral sides of each of the bases.

3. The distribution terminal according to claim 1, wherein each of the bases has a forward end and a rearward end and the module has a forward end and a rearward end, and wherein the distribution terminal further comprises:

latches mounted to the forward and rearward ends of each of the bases and the module for releasably attaching the module to any one of the bases.

4. The distribution terminal according to claim 1, further comprising an excessive voltage protector mounted in the module.

5. A distribution terminal for connecting a plurality of drop wires to a plurality of distribution wires, comprising:

a plurality of bases, each of the bases having a platform and lateral sides on opposite edges of the platform;

mating connectors on each of the lateral sides of the bases for securing adjacent bases together;

each of the bases having at least two conductive penetrators extending through the platform, each of the penetrators having a terminal end prewired to one of the distribution wires;

at least one module secured to one of the bases over the platform, the module having a pair of holes for receiving a corresponding pair of the drop wires therein;

a pair of terminal clips mounted within the module, each of the terminal clips releasably engaging one of the penetrators when the module is secured to the base so that the module is removable from the base without disconnecting the distribution wires prewired to the terminal ends of the penetrators; and an actuator for pushing the drop wires into engagement with the terminal clips.

6. The distribution terminal according to claim 5, wherein the mating connectors comprise:

a lug protruding from one of the lateral sides of each of the bases and a slot located on the other of the lateral sides of each of the bases.

7. The distribution terminal according to claim 5, wherein the actuator comprises:

a plunger mounted for reciprocal movement within the module adjacent to the holes of the module; and a rotary member that engages the plunger and protrudes from the module, the rotary member translating rotational motion of the rotary member into reciprocal movement of the plunger.

8. The distribution terminal according to claim 5, wherein the actuator comprises:

a plunger mounted for reciprocal movement within the module adjacent to the holes of the module;

a cooperating keyway between the plunger and the module for preventing rotation of the plunger relative to the module; and a screw that threadingly engages the plunger and protrudes from the module, the screw translating rotational motion of the screw into reciprocal movement of the plunger.

9. The distribution terminal according, to claim 5, wherein the actuator comprises:

a plunger mounted for reciprocal movement within the module between an open position and a closed position, the plunger having a pair of apertures which register with the holes of the module, the plunger having at least a portion located between the holes of the module and the terminal clips so that insertion of the drop wires into the holes of the module while the plunger is in the open position causes the drop wires to pass through the apertures of the plunger and locate adjacent an entry edge of each of the terminal clips;

a cooperating protuberance and slot between the plunger and the module for preventing rotation of the plunger relative to the module; and a screw that threadingly engages the plunger and protrudes from the module, the screw translating rotational motion of the screw into reciprocal movement of the plunger, whereby rotation of the screw in one direction while the plunger is in the open position and the drop wires are inserted through the holes of the module and the apertures of the plunger causes the plunger to push the drop wires past the entry edges of the terminal clips.

10. The distribution terminal according to claim 9, wherein:

the plunger moves along an axis;

the plunger has an axially extending cavity for receiving the terminal clips; and each of the apertures extends entirely through the plunger from a forward end to a rearward end of the plunger and intersects the cavity in the plunger.

11. The distribution terminal according to claim 5, wherein each of the penetrators has a socket which is engaged by one of the terminal clips when the module is secured to the base.

12. The distribution terminal according to claim 5, wherein each of the bases has a forward end and a rearward end and the module has a forward end and a rearward end, and wherein the distribution terminal further comprises:

latches mounted to the forward and rearward ends of each of the bases and the module for releasably attaching the module to any one of the bases.

13. The distribution terminal according to claim 5, further comprising an excessive voltage protector mounted in the module.

14. A module releasably attached to a distribution terminal for connecting a plurality of drop wires to a plurality of distribution wires, the distribution terminal having a base assembly comprising at least one platform, the platform having electrical contacts prewired to the distribution wires, the module comprising;

a latch member on the module for securing the module to the base assembly over the platform;

a pair of terminal clips mounted within the module, each of the terminal clips having a portion that releasably engages one of the electrical contacts when the module is secured to the base assembly so that the module is removable from the base without disconnecting the distribution wires prewired to the electrical contacts, each of the terminal clips having an entry edge leading to a slit having opposed sharp edges biased toward each other;

the module having a pair of holes adjacent the terminal clips for receiving a pair of the drop wires; and a plunger reciprocally mounted in the module for movement between an open position and a closed position, the plunger being located for pushing the drop wires past the entry edges of the terminal clips and into the slits.

15. The module according to claim 14, further comprising:

a pair of apertures in the plunger that register with the pair of holes of the module so that insertion of the drop wires into the holes of the module while the plunger is in the open position causes each of the drop wires to pass through the apertures of the plunger and to locate adjacent the entry edge of one of the terminal clips;

a cooperating keyway between the plunger and the module for preventing rotation of the plunger relative to the module; and a screw that threadingly engages the plunger and protrudes from the module, the screw translating rotational motion of the screw into reciprocal movement of the plunger, whereby rotation of the screw in one direction while the plunger is in the open position and the drop wires are inserted through the holes of the module and the apertures of the plunger causes the plunger to push the drop wires past the entry edges of the terminal clips and into the slits.

16. The module according to claim 14, wherein:

the plunger moves along an axis;

the plunger has an axially extending cavity for receiving the terminal clips; and each of the pair of apertures extends through the plunger from a forward end to a rearward end of the plunger and through the cavity.

17. The module according to claim 14 wherein the plunger moves along an axis, and wherein each of the holes of the module has a greater axial dimension than each of the apertures of the plunger.

18. The module according to claim 14, further comprising an excessive voltage protector mounted in the module.

19. A distribution terminal module for mounting to a base assembly of a distribution system for electrically connecting a pair of drop wires to incoming distribution wires of the distribution system, the base assembly having a plurality of electrical contacts prewired to the distribution wires, the module comprising:

a latch member mounted to the module for securing the module to the base assembly;

a pair of terminal clips mounted within the module, each of the terminal clips having a portion that releasably engages one of the electrical contacts when the module is secured to the base assembly so that the module is removable from the base without disconnecting the distribution wires prewired to the electrical contacts, each of the terminal clips having an entry edge leading to a slit having opposed sharp edges biased toward each other;

the module having a pair of holes adjacent the terminal clips;

a plunger mounted in the module for movement along an axis between an open position and a closed position, the plunger having apertures that register with the holes of the module for receiving and positioning the ends of the drop wires adjacent the entry edges of the terminal clips while the plunger is in the open position;

a cooperating keyway between the plunger and the module for preventing rotation of the plunger relative to the module; and a screw that threadingly engages the plunger and protrudes from the module, the screw translating rotational motion of the screw into reciprocal movement of the plunger, whereby rotation of the screw in one direction while the plunger is in the open position and the drop wires are inserted through the holes of the module and the apertures of the plunger causes the plunger to push the drop wires past the entry edges of the terminal clips and into the slits.

20. The module according to claim 19, further comprising an excessive voltage protector mounted in the module.

* * * * *

UNITED STATES PATENT AND TRADEMARK OFFICE

CERTIFICATE OF CORRECTION

PATENT NO. : 6,315,595 B1
DATED : November 13, 2001
INVENTOR(S) : Richard LaPorte, Casimir Z. Cwirzen and Roger L. Paradis It is certified that error appears in the above-identified patent and that said Letters Patent is hereby corrected as shown below:

Title page,
Item [75], Inventors, change "Cwiren" to -- Cwirzen --.

Signed and Sealed this

Seventh Day of May, 2002

*Attest:*

*Attesting Officer*

JAMES E. ROGAN
*Director of the United States Patent and Trademark Office*